US008430401B1

(12) United States Patent
Kuo

(10) Patent No.: US 8,430,401 B1
(45) Date of Patent: Apr. 30, 2013

(54) PAPER DESKEW DEVICE FOR AUTOMATIC DOCUMENT FEEDER

(75) Inventor: Ping-Hung Kuo, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 0 days.

(21) Appl. No.: 13/416,932

(22) Filed: Mar. 9, 2012

(30) Foreign Application Priority Data

Jan. 6, 2012 (TW) ..... 101100623 A

(51) Int. Cl.
*B65H 9/00* (2006.01)
*B65H 9/04* (2006.01)

(52) U.S. Cl.
USPC ..... 271/226; 271/242; 271/902; 271/244

(58) Field of Classification Search ..... 271/226, 271/242, 902, 244
See application file for complete search history.

(56) References Cited

U.S. PATENT DOCUMENTS 3,980,295 A * 9/1976 Kleid ..... 271/242
4,941,655 A * 7/1990 Winkler ..... 271/242

* cited by examiner

*Primary Examiner* — Luis A Gonzalez
(74) *Attorney, Agent, or Firm* — Kirton McConkie; Evan R. Witt

(57) ABSTRACT

A paper deskew device for an automatic document feeder includes a transport roller assembly, a deskew roller assembly, and a power transmission mechanism. The transport roller assembly includes a first gear. The deskew roller assembly includes a second gear. Before a front edge of a paper is contacted with the deskew roller assembly, the first gear links the power transmission mechanism and the second gear, so that the transport roller assembly and the deskew roller assembly are respectively rotated in a first direction and a second direction. Once the front edge of the paper is contacted with the deskew roller assembly, the deskew roller assembly is continuously rotated in a second direction for a second direction for correcting the skew phenomenon of the paper. Afterwards, the second gear and the deskew roller assembly are driven by the first gear to be rotated in the first direction to transport the paper.

10 Claims, 12 Drawing Sheets

PAPER DESKEW DEVICE FOR AUTOMATIC DOCUMENT FEEDER

FIELD OF THE INVENTION

The present invention relates to a paper deskew device, and more particularly to a paper deskew device for an automatic document feeder.

BACKGROUND OF THE INVENTION

For processing a large number of papers, a commercially available office machine (e.g. a scanner, a printer or a multi-function peripheral) is usually equipped with an automatic document feeder. By means of the automatic document feeder, a stack of papers can be successively fed into the office machine in order to perform the scanning task or the printing task. However, if the paper is not placed at the proper position or if the paper is aslant fed into the automatic document feeder, the printed or scanned image is skewed. For solving these drawbacks, the automatic document feeder usually has a special device for correcting the skewed paper before the paper is introduced to the working region (e.g. the scanning region or the printing region) in order to decrease the skew degree of the printed or scanned image.

In accordance with the conventional approaches of correcting the skewed paper, the rotation of a transmission roller is selectively stopped or reversed during the process of feeding the paper. Hereinafter, the approaches of correcting the skewed paper by stopping the transmission roller will be illustrated with reference to FIGS. 1A, 1B and 1C. FIG. 1A is a schematic side view illustrating a conventional paper deskew device during the paper-feeding task is performed. FIG. 1B is a schematic side view illustrating the conventional paper deskew device of FIG. 1A during the deskew task is performed. FIG. 1C is a schematic side view illustrating the conventional paper deskew device of FIG. 1A after the paper-feeding task is performed.

As shown in FIG. 1A, the conventional paper deskew device 1 comprises a feed roller 11, a transfer roller 12, and a transmission roller 13.

When the paper-feeding task starts, the feed roller 11 and the transfer roller 12 are rotated in a first direction "a" to feed a paper 14 into the office machine. Under this circumstance, the transmission roller 13 is in a static status. If the paper 14 is not skewed, the both sides of the front edge of the paper 14 are simultaneously contacted with the transmission roller 13. On the other hand, if the paper is skewed, a side of the front edge of the paper 14 is firstly contacted with the transmission roller 13. Meanwhile, the paper 14 is blocked by the transmission roller 13 from being continuously advanced. Since the paper 14 is continuously transported by the transfer roller 12, the front edge of the paper 14 is slightly upturned (see FIG. 1B). Until the other side of the front edge of the paper 14 is moved to the transmission roller 13, the both sides of the front edge of the paper 14 are both contacted with the transmission roller 13. Meanwhile, the paper 14 is not continuously advanced, and thus the purpose of correcting the skewed paper is achieved.

After the skewed paper has been corrected, the transmission roller 13 is rotated in the first direction "a" (see FIG. 1C) to feed the paper 14 into the office machine.

Hereinafter, the approaches of correcting the skewed paper by reversing the transmission roller will be illustrated with reference to FIGS. 2A, 2B and 2C. FIG. 2A is a schematic side view illustrating another conventional paper deskew device during the paper-feeding task is performed. FIG. 2B is a schematic side view illustrating the conventional paper deskew device of FIG. 2A during the deskew task is performed. FIG. 2C is a schematic side view illustrating the conventional paper deskew device of FIG. 2A after the paper-feeding task is performed.

As shown in FIG. 2A, the conventional paper deskew device 2 comprises a feed roller 21, a transfer roller 22, and a transmission roller 23.

Except for the following items, the operations of the paper deskew device 2 are substantially identical to those of the paper deskew device 1. In contrast, after the paper 24 has been transported across the transfer roller 22 for a certain time period, the transmission roller 23 is rotated in a second direction "b" (see FIG. 2B) from the original static status. Meanwhile, the paper 24 is blocked by the transmission roller 23 from being continuously advanced. Since the paper 24 is continuously transported by the transfer roller 22, the front edge of the paper 24 is slightly upturned. Until the other side of the front edge of the paper 24 is moved to the transmission roller 23, the both sides of the front edge of the paper 24 are both contacted with the transmission roller 23, so that the purpose of correcting the skewed paper is achieved.

After the skewed paper has been corrected, the transmission roller 23 is rotated in the first direction "a" (see FIG. 2C) to feed the paper 24 into the office machine.

The above conventional paper deskew devices, however, still have some drawbacks. For example, it takes an additional time period for allowing the motor to drive start-up of the transmission roller from the static status. Moreover, it also takes another time period to change the driving direction of the motor. In other words, the time period for performing the scanning or printing task will be increased. Since the driving direction of the motor is frequently changed or the motor is frequently started from the static status, the possibility of causing damage of the motor will be increased. Under this circumstance, the use life of the automatic document feeder will be shortened.

Therefore, there is a need of providing an improved paper deskew device for correcting the skewed paper.

SUMMARY OF THE INVENTION

The present invention provides an active-type paper deskew device without the need of changing the operating status of the motor.

In accordance with an aspect of the present invention, there is provided a paper deskew device for an automatic document feeder. The paper deskew device is used for correcting a skew phenomenon of a paper fed into the automatic document feeder. The paper deskew device includes a transport roller assembly and a deskew roller assembly. The transport roller assembly includes a shaft and a first transport roller. The first transport roller is sheathed around a first end of the shaft, and driven by the shaft to be rotated in a first direction. The deskew roller assembly is disposed on the shaft, and includes a first deskew roller. The first deskew roller is sheathed around the first end of the shaft. A movement of the paper is firstly driven by the first deskew roller and then driven by the first transport roller. Before the movement of the paper is driven by the first deskew roller, the first deskew roller is rotated in a second direction. Once a front edge of the paper is contacted with the first deskew roller, the first deskew roller is continuously rotated in the second direction for a predetermined time period, and then the first deskew roller is rotated in the first direction, so that the paper is transported to the first transport roller. After the paper is completely departed from the first deskew roller, the first deskew roller is rotated in the second direction again. The first direction is opposed to the second direction.

In an embodiment, the transport roller assembly further includes a first gear. The first gear is sheathed around the shaft and located beside the first transport roller and driven by the shaft to be rotated in the first direction. Moreover, the first gear has a first bulge. The deskew roller assembly further includes a second gear. The second gear is connected to a sidewall of the first deskew roller and rotated with the first deskew roller. Moreover, the second gear has a second bulge.

In an embodiment, the paper deskew device further includes a power transmission mechanism. The power transmission mechanism is connected with the first gear and the second gear for driving the first deskew roller to be rotated in the second direction.

In an embodiment, after the first deskew roller is rotated in the second direction for the predetermined time period, the first bulge of the first gear and the second bulge of the second gear are contacted with each other, so that the second gear is pushed by the first gear to be rotated in the first direction and the first deskew roller is rotated in the first direction.

In an embodiment, a radius of the first deskew roller is smaller than a radius of the first transport roller. After the paper is driven by the first transport roller to be moved, the paper allows the second bulge of the second gear to be separate from the first bulge of the first gear.

In an embodiment, the power transmission mechanism includes a damping gear set, which includes a first damping gear, a second damping gear and a damping spring. The damping spring is disposed within the first damping gear and the second damping gear.

In an embodiment, before the first deskew roller is rotated for the predetermined time period, the first damping gear, the second damping gear and the damping spring are rotated in the same direction. Moreover, after the first deskew roller is rotated for the predetermined time period, the first damping gear and the second damping gear are rotated in opposite directions.

In an embodiment, the power transmission mechanism further includes a third gear, a fourth gear and a fifth gear. The third gear is engaged with the first gear and the first damping gear, the fourth gear is engaged with the second damping gear and the fifth gear, and the fifth gear is engaged with the fourth gear and the second gear.

In an embodiment, the transport roller assembly further includes a second transport roller, a first idler wheel and a second idler wheel. The second transport roller is sheathed around a second end of the shaft and synchronously rotated with the first transport roller. A radius of the second transport roller is equal to a radius of the first transport roller. The first idler wheel is disposed over the first transport roller and driven by the first transport roller to be rotated. In addition, the second idler wheel is disposed over the second transport roller and driven by the second transport roller to be rotated.

In an embodiment, the deskew roller assembly further includes a second deskew roller, a third idler wheel and a fourth idler wheel. The second deskew roller is sheathed around a second end of the shaft and synchronously rotated with the first deskew roller. A radius of the second deskew roller is equal to a radius of the first deskew roller. The third idler wheel is disposed over the first deskew roller and driven by the first deskew roller to be rotated. In addition, the second idler wheel is disposed over the second deskew roller and driven by the second deskew roller to be rotated.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a paper deskew device for correcting a skewed paper during the process of feeding the paper.

Figure 1A:
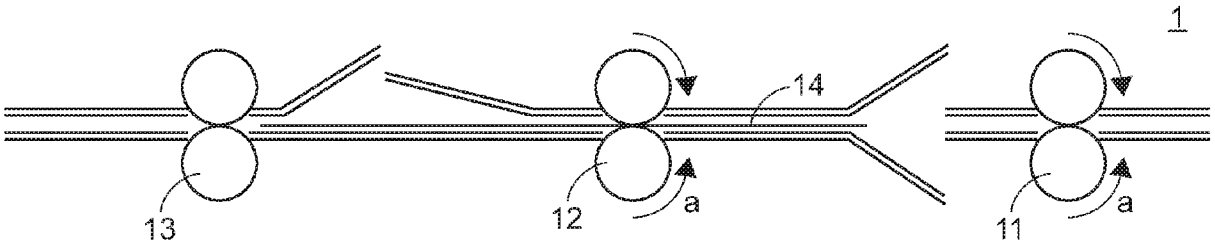
FIG.1A(PRIOR ART)
FIG. 1A is a schematic side view illustrating a conventional paper deskew device during the paper-feeding task is performed.
Figure 1B:
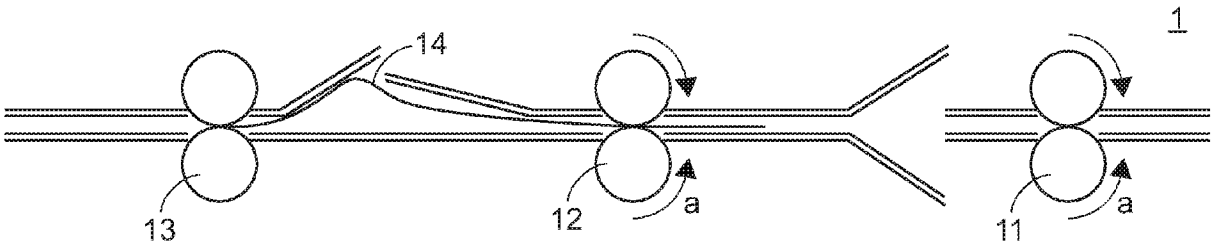
FIG.1B(PRIOR ART)
FIG. 1B is a schematic side view illustrating the conventional paper deskew device of FIG. 1A during the deskew task is performed.
Figure 1C:
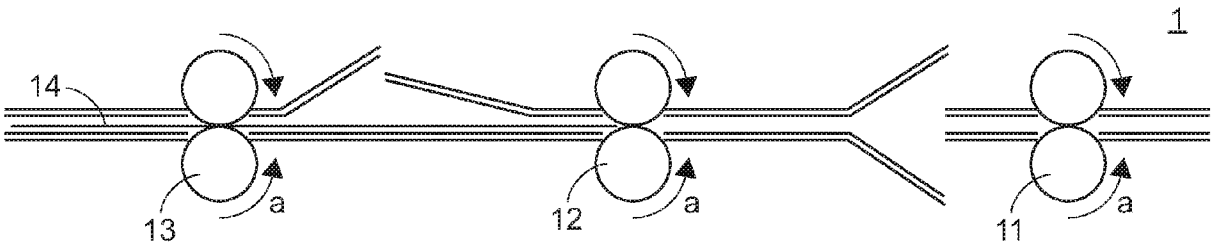
FIG.1C(PRIOR ART)
FIG. 1C is a schematic side view illustrating the conventional paper deskew device of FIG. 1A after the paper-feeding task is performed.
Figure 2A:
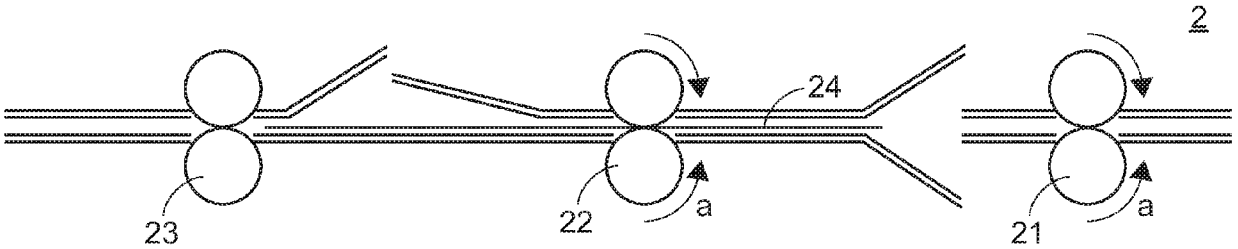
FIG.2A(PRIOR ART)
FIG. 2A is a schematic side view illustrating another conventional paper deskew device during the paper-feeding task is performed.
Figure 2B:
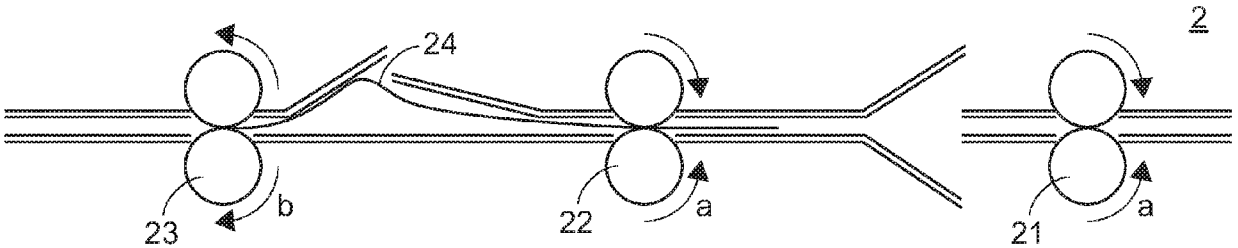
FIG.2B(PRIOR ART)
FIG. 2B is a schematic side view illustrating the conventional paper deskew device of FIG. 2A during the deskew task is performed.
Figure 2C:
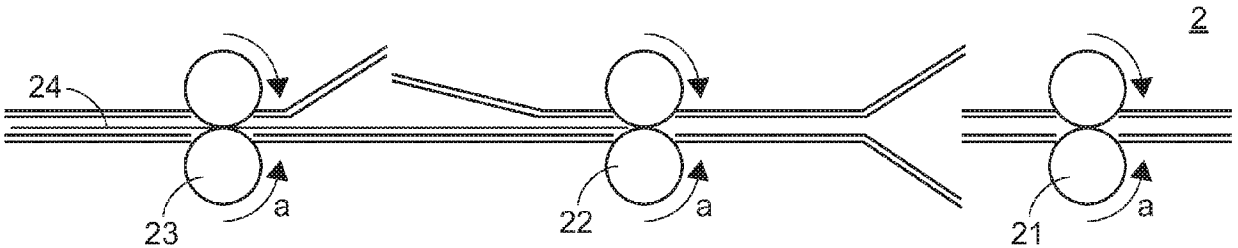
FIG.2C(PRIOR ART)
FIG. 2C is a schematic side view illustrating the conventional paper deskew device of FIG. 2A after the paper-feeding task is performed.
Figure 3:
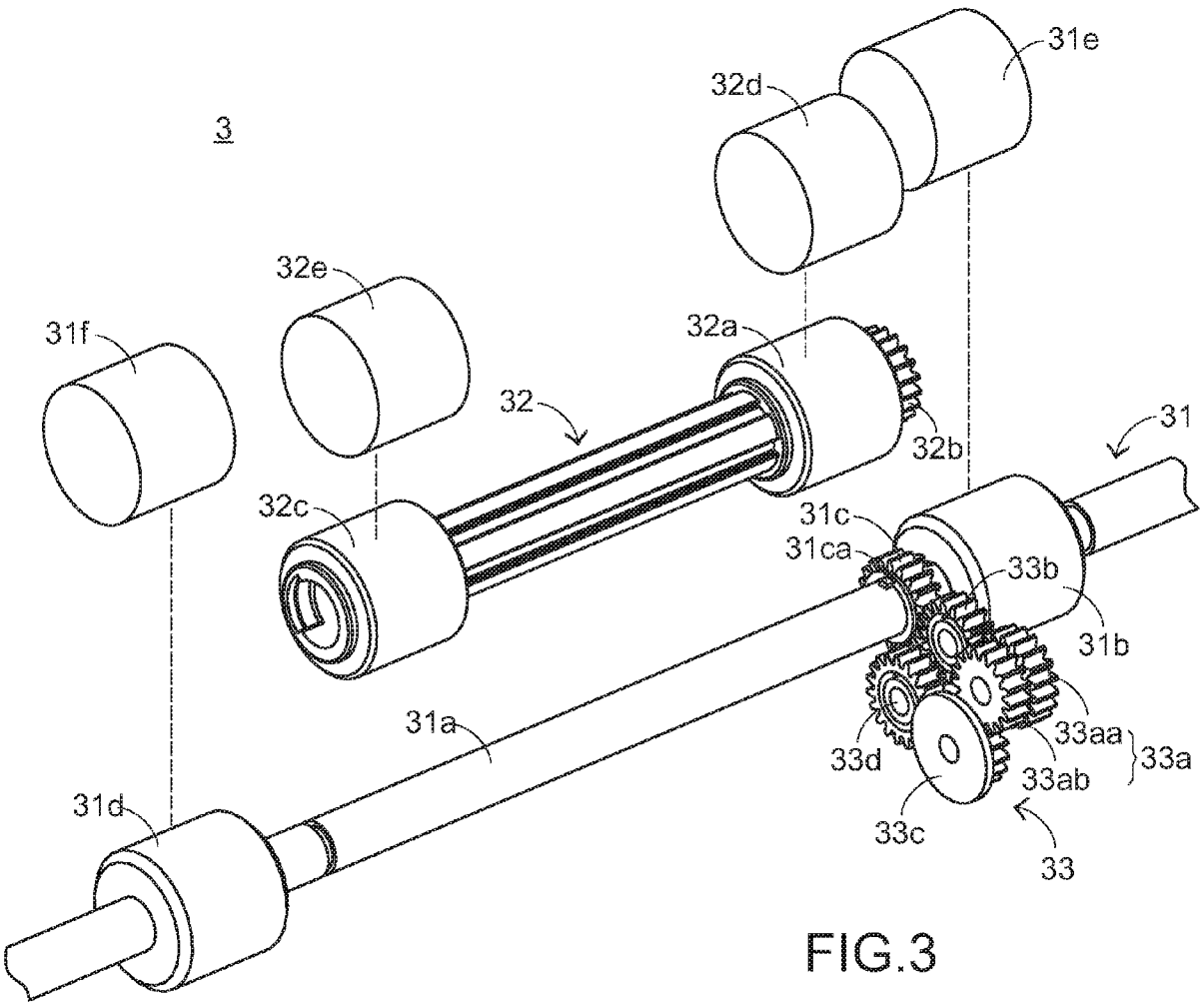
FIG. 3 is a schematic exploded view illustrating a paper deskew device according to an embodiment of the present invention and taken along a first viewpoint.
Figure 4:
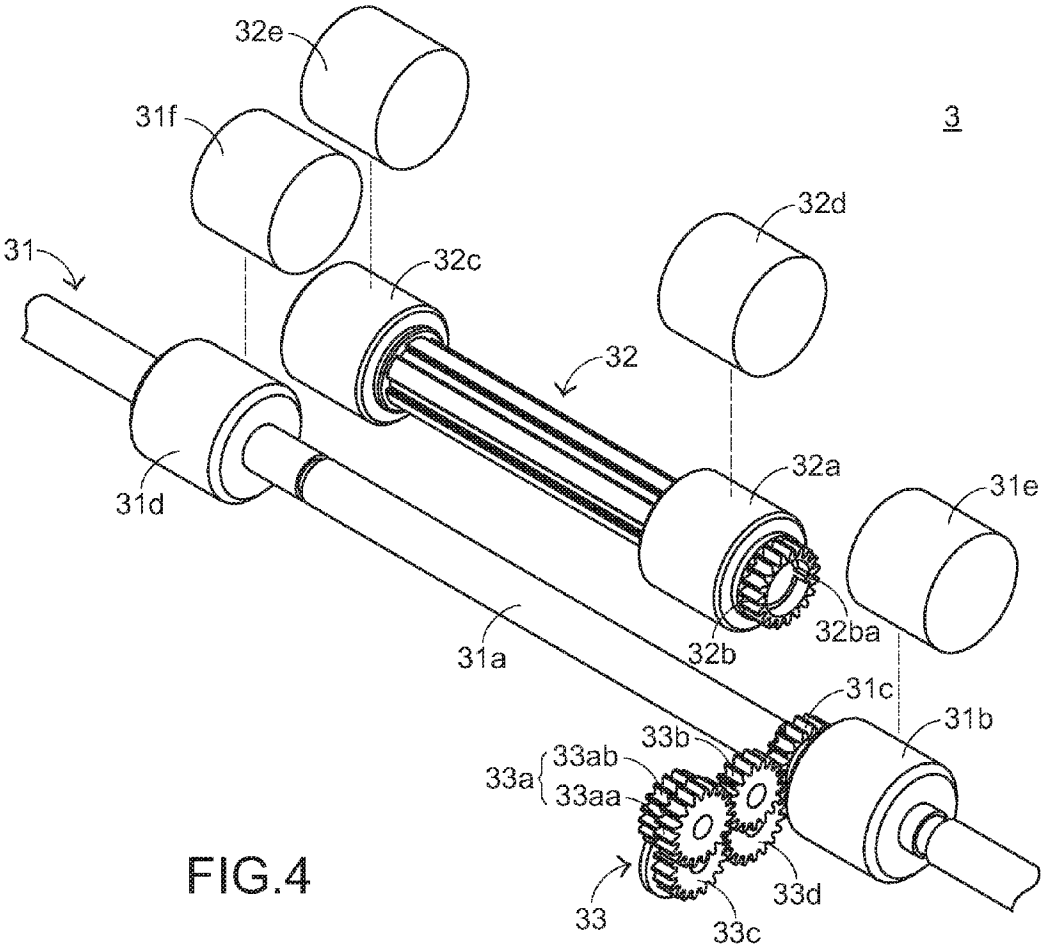
FIG. 4 is a schematic exploded view illustrating the paper deskew device of FIG. 3 and taken along a second viewpoint.

Please refer to FIG. 3 and FIG. 4. FIG. 3 is a schematic exploded view illustrating a paper deskew device according to an embodiment of the present invention and taken along a first viewpoint. FIG. 4 is a schematic exploded view illustrating the paper deskew device of FIG. 3 and taken along a second viewpoint.

Hereinafter, the components of the paper deskew device will be illustrated in more details. As shown in FIGS. 3 and 4, the paper deskew device 3 comprises a transport roller assembly 31, a deskew roller assembly 32, and a power transmission mechanism 33.

The transport roller assembly 31 comprises a shaft 31*a*, a first transport roller 31*b*, a first gear 31*c*, a second transport roller 31*d*, a first idler wheel 31*e*, and a second idler wheel 31*f*. The first gear 31*c* comprises a first bulge 31*ca*. The first bulge 31*ca* is protruded from a sidewall of the first gear 31*c*.

The deskew roller assembly 32 comprises a first deskew roller 32*a*, a second gear 32*b*, a second deskew roller 32*c*, a third idler wheel 32*d*, and a fourth idler wheel 32*e*. The second gear 32*b* comprises a second bulge 32*ba*. The second bulge 32*ba* is protruded from an inner surface of the second gear 32*b*.

The power transmission mechanism 33 comprises a damping gear set 33*a*, a third gear 33*b*, a fourth gear 33*c*, and a fifth gear 33*d*. The damping gear set 33*a* comprises a first damping gear 33*aa*, a second damping gear 33*ab*, and a damping spring 33*ac* (see FIG. 6).

Moreover, the radius of each of the first deskew roller 32*a* and the second deskew roller 32*c* is smaller than the radius of each of the first transport roller 31*b* and the second transport roller 31*d*.

Figure 5:
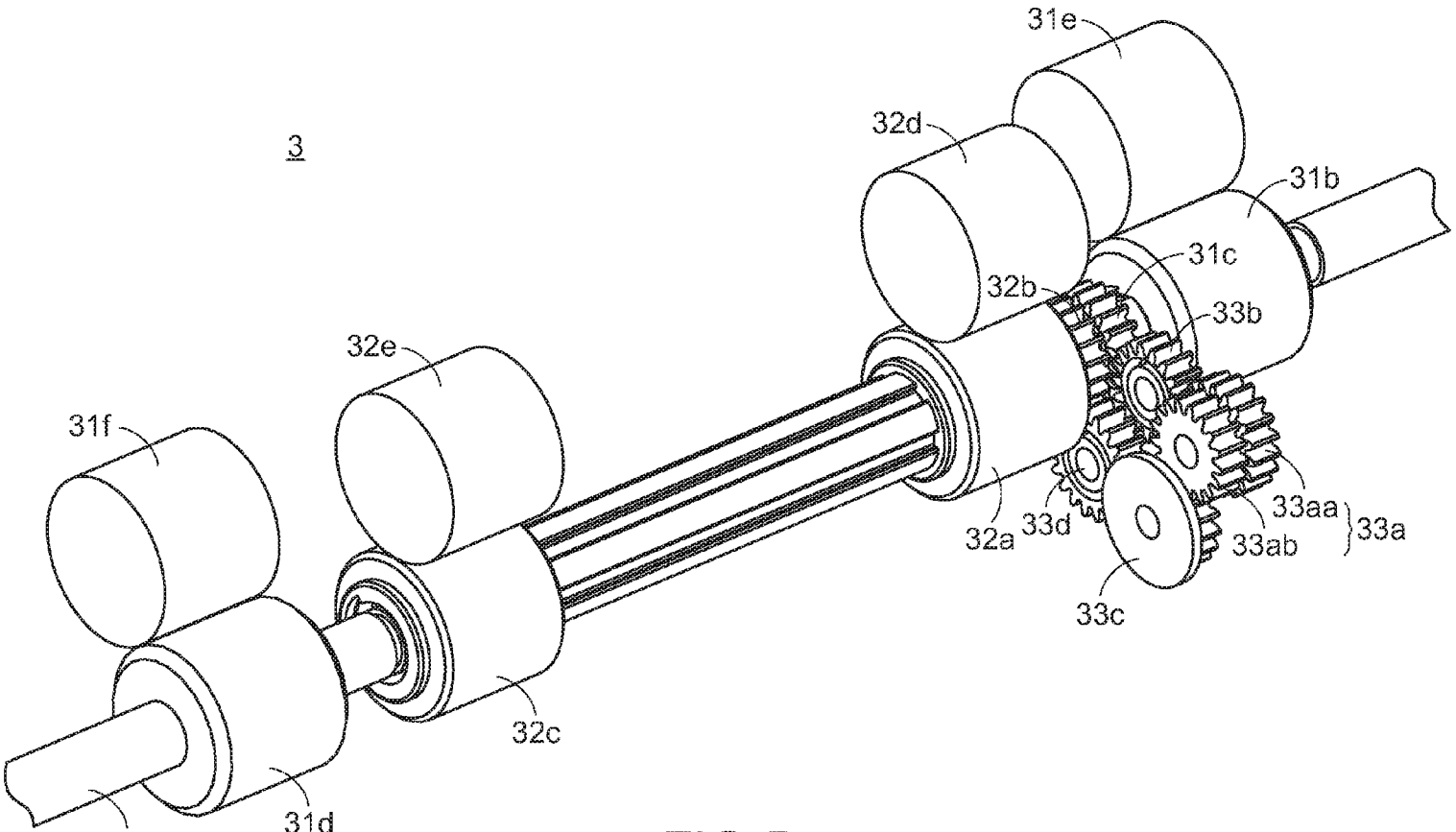
FIG. 5 is a schematic perspective view illustrating the paper deskew device according to the embodiment of the present invention.
Figure 6:
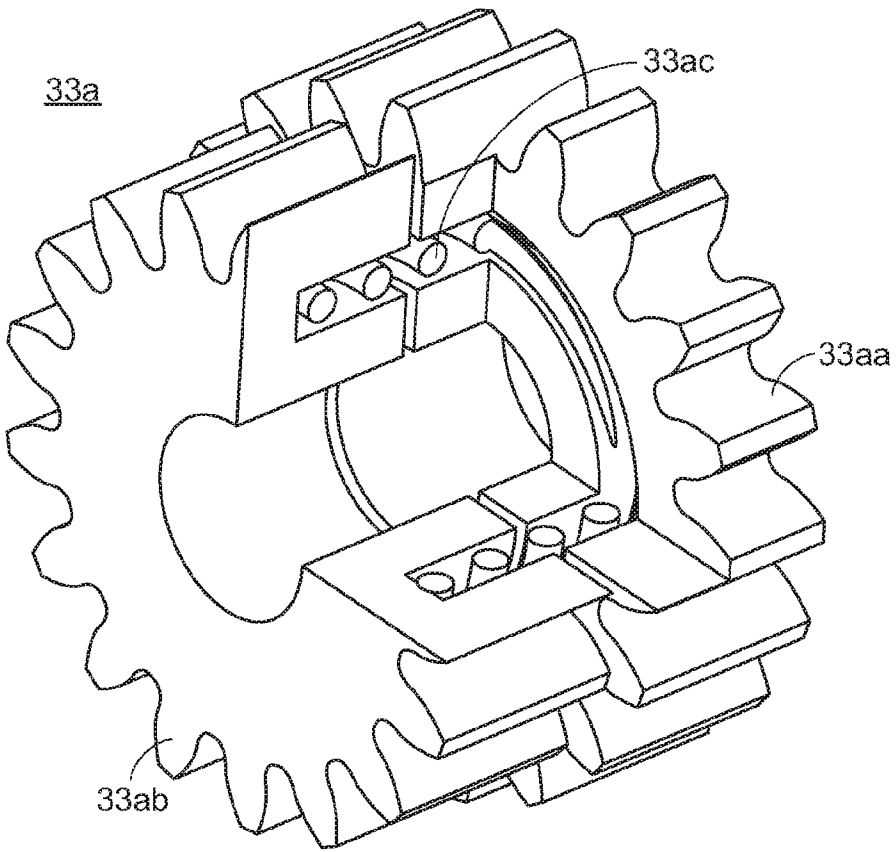
FIG. 6 is a schematic cutaway view illustrating the damping gear set of the paper deskew device according to the embodiment of the present invention.

Hereinafter, a process of assembling the paper deskew device will be illustrated with reference to FIGS. 3 and 4 as well as FIGS. 5 and 6. FIG. 5 is a schematic perspective view illustrating the paper deskew device according to the embodiment of the present invention. FIG. 6 is a schematic cutaway view illustrating the damping gear set of the paper deskew device according to the embodiment of the present invention.

Firstly, the first transport roller 31*b*, the first gear 31*c* and the second transport roller 31*d* of the transport roller assembly 31 are sheathed around the shaft 31*a*. The first transport roller 31*b* and the second transport roller 31*d* are respectively located at two ends of the shaft 31*a*. The first gear 31*c* is located beside the first transport roller 31*b*. The first idler wheel 31*e* is disposed over the first transport roller 31*b*, and nestled against the first transport roller 31*b*. The second idler wheel 31*f* is disposed over the second transport roller 31*d*, and nestled against the second transport roller 31*d*.

Moreover, the first transport roller 31*b*, the first gear 31*c* and the second transport roller 31*d* are driven by the shaft 31*a*, so that the first transport roller 31*b*, the first gear 31*c* and the second transport roller 31*d* are synchronously rotated with the shaft 31*a*. The first idler wheel 31*e* is driven by the first transport roller 31*b* to be rotated. The second idler wheel 31*f* is driven by the second transport roller 31*d* to be rotated.

Next, the first deskew roller 32*a*, the second gear 32*b* and the second deskew roller 32*c* of the deskew roller assembly 32 are also sheathed around the shaft 31*a*, and arranged between the first transport roller 31*b* and the second transport roller 31*d*. In addition, the first deskew roller 32*a* is located beside the first transport roller 31*b*, and the second deskew roller 32*c* is located beside the second transport roller 31*d*. The second gear 32*b* is connected with a sidewall of the first deskew roller 32*a*. The first bulge 31*ca* of the first gear 31*c* is covered by the inner surface of the second gear 32*b*. The third idler wheel 32*d* is disposed over the first deskew roller 32*a*, and nestled against the first deskew roller 32*a*. The fourth idler wheel 32*e* is disposed over the second deskew roller 32*c*, and nestled against the second deskew roller 32*c*.

The second gear 32*b* is synchronously rotated with the first deskew roller 32*a*. The second deskew roller 32*c* is also synchronously rotated with the first deskew roller 32*a*. The third idler wheel 32*d* is driven by the first deskew roller 32*a* to be rotated. The fourth idler wheel 32*e* is driven by the second deskew roller 32*c* to be rotated.

Afterwards, the third gear 33*b* of the power transmission mechanism 33 is engaged with the first gear 31*c* and the first damping gear 33*aa*, the second damping gear 33*ab* is nestled against the first damping gear 33*aa*, and the damping spring 33*ac* is disposed within the first damping gear 33*aa* and the second damping gear 33*ab* (see FIG. 6). In addition, the fourth gear 33*c* is engaged with the second damping gear 33*ab* and the fifth gear 33*d*, and the fifth gear 33*d* is engaged with the fourth gear 33*c* and the second gear 32*b*. Meanwhile, the paper deskew device 3 is assembled.

It is noted that the third idler wheel 32*d* and the fourth idler wheel 32*e* are located upstream of the paper-transferring path relative to the first idler wheel 31*e* and the second idler wheel 31*f*. Consequently, during the process of transferring the paper, the paper is firstly driven by the first deskew roller 32*a* and the second deskew roller 32*c*, and then driven by the first transport roller 31*b* and the second transport roller 31*d*.

Figure 7:
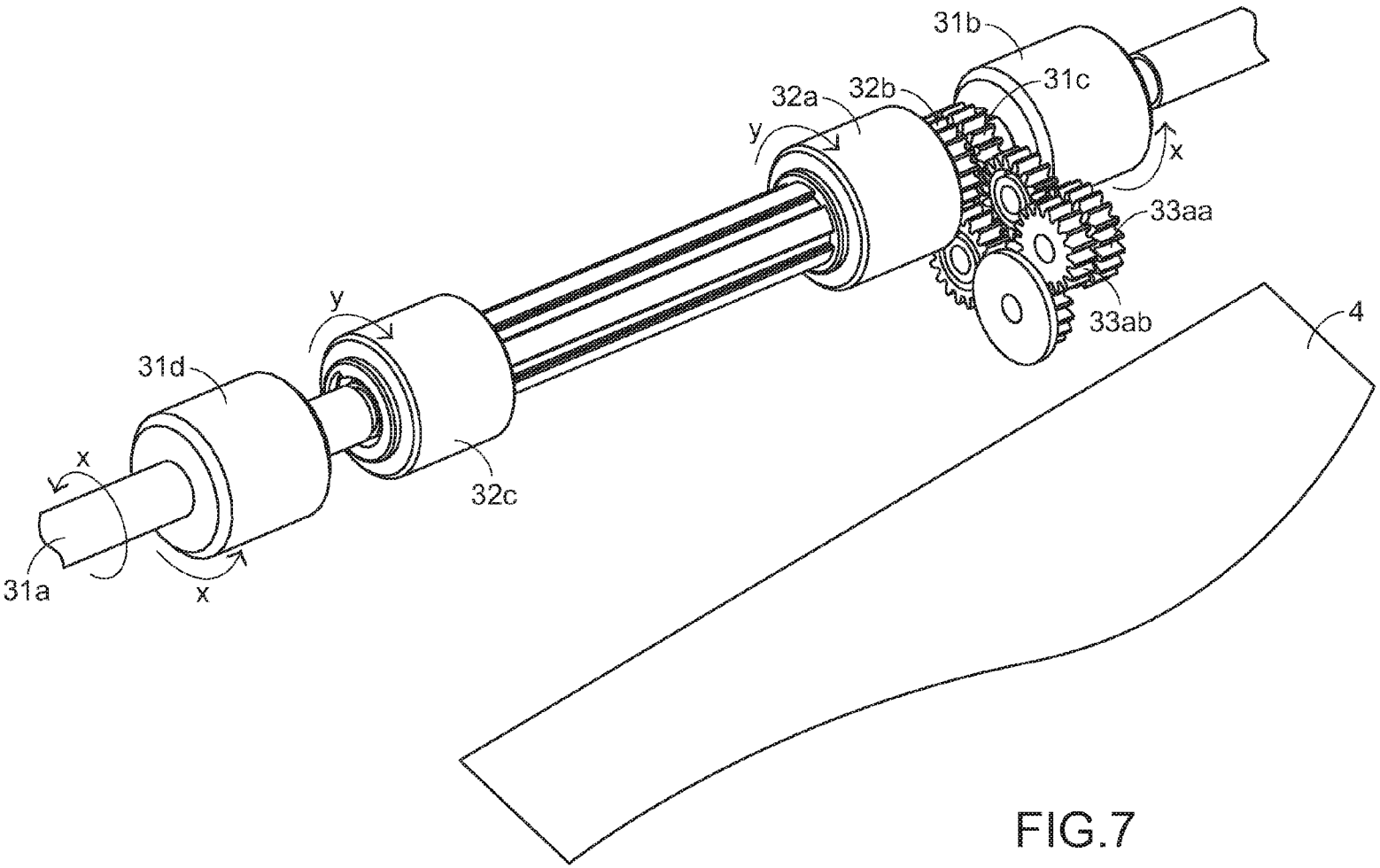
FIG. 7 is a schematic perspective view illustrating the paper deskew device according to the embodiment of the present invention, in which the front edge of the paper is not contacted with the deskew roller assembly.
Figure 8:
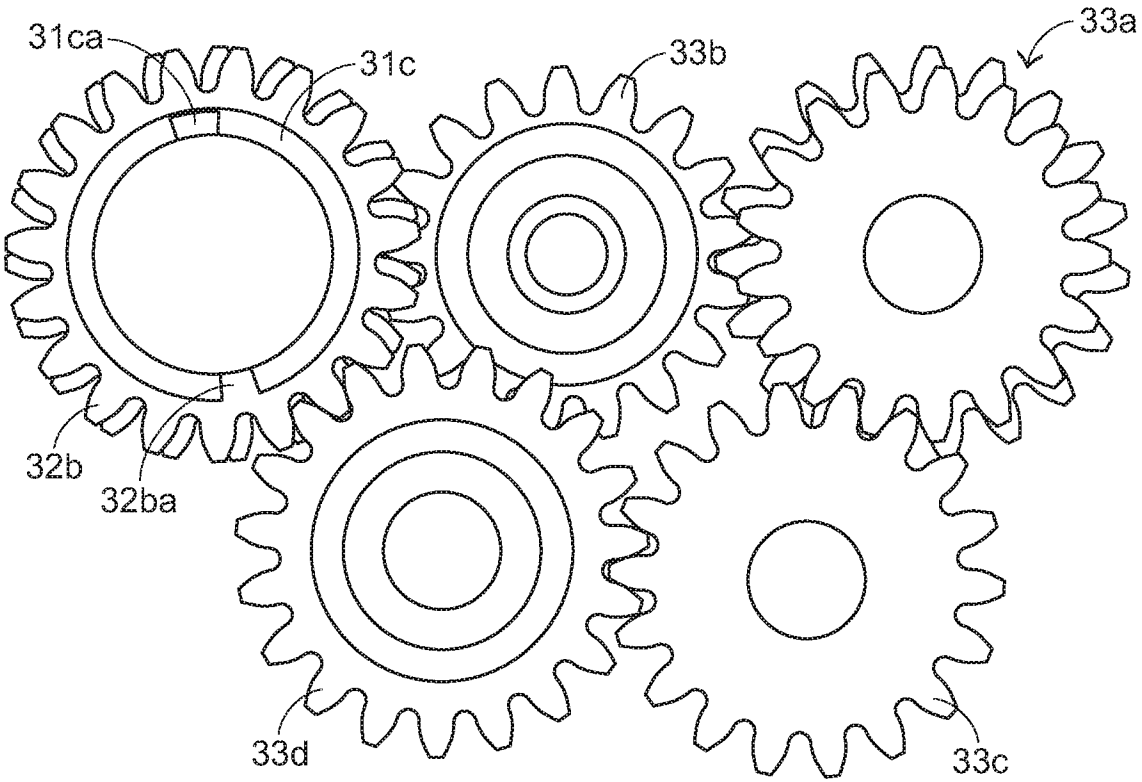
FIG. 8 is a schematic side view illustrating the first gear, the second gear and the power transmission mechanism of the paper deskew device according to the embodiment of the present invention, in which the front edge of the paper is not contacted with the deskew roller assembly.
Figure 9:
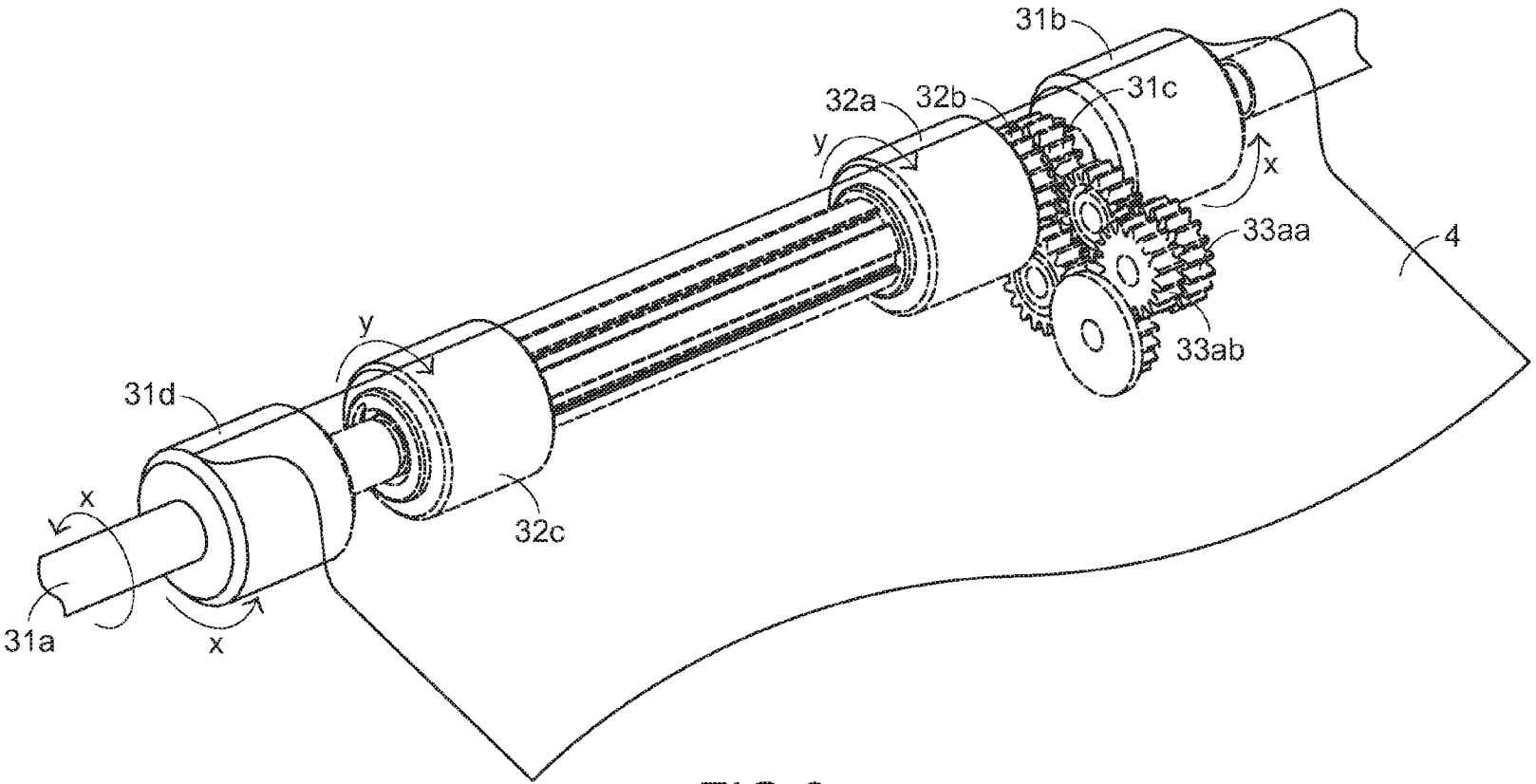
FIG. 9 is a schematic perspective view illustrating the paper deskew device according to the embodiment of the present invention, in which the front edge of the paper is completely contacted with the deskew roller assembly.
Figure 10:
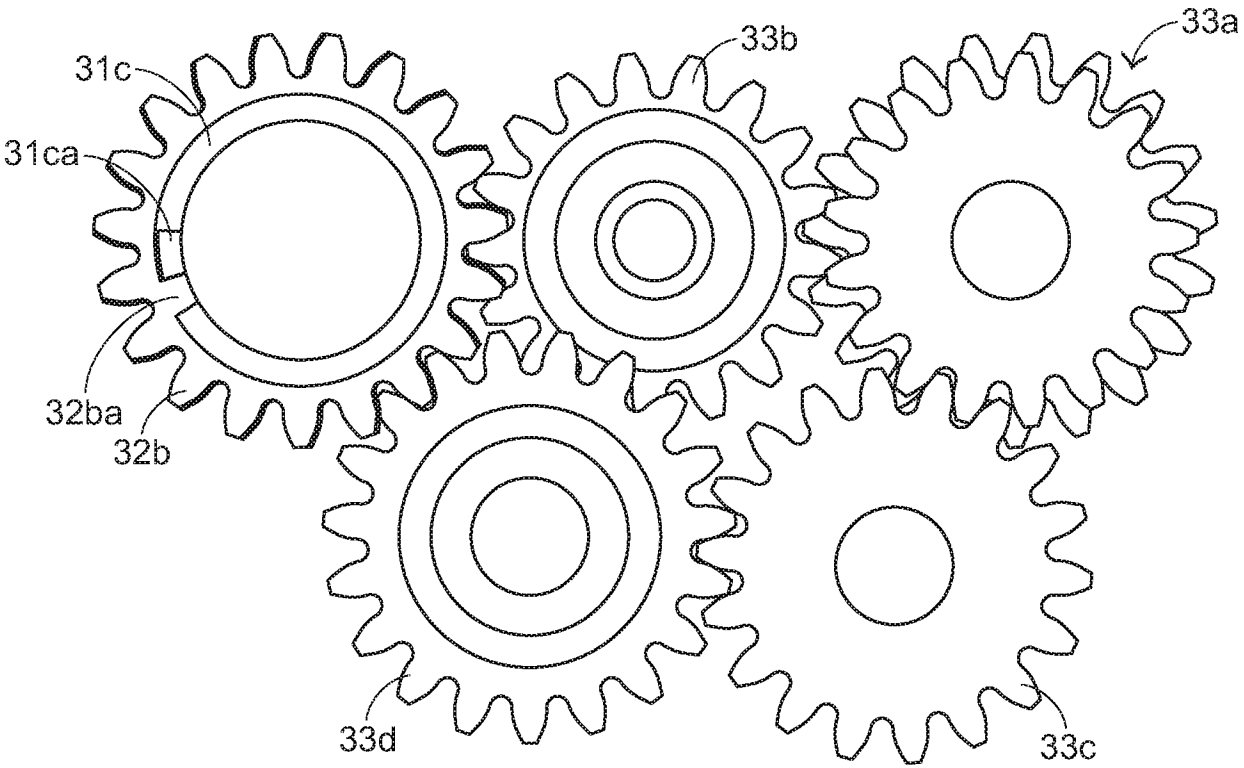
FIG. 10 is a schematic side view illustrating the first gear, the second gear and the power transmission mechanism of the paper deskew device according to the embodiment of the present invention, in which the front edge of the paper is completely contacted with the deskew roller assembly.
Figure 11:
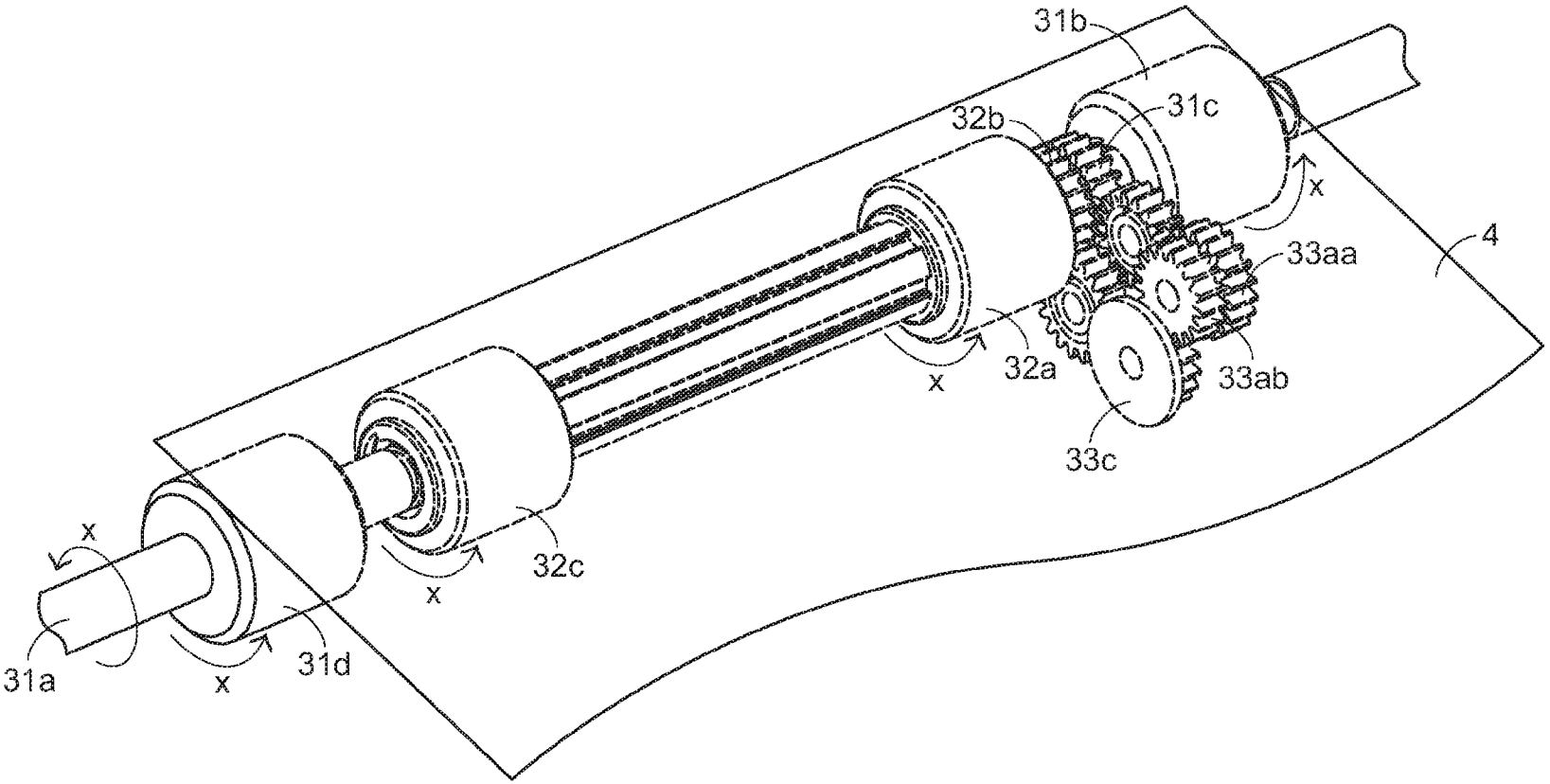
FIG. 11 is a schematic perspective view illustrating the paper deskew device according to the embodiment of the present invention, in which the movement of the paper is driven by the transport roller assembly.
Figure 12:
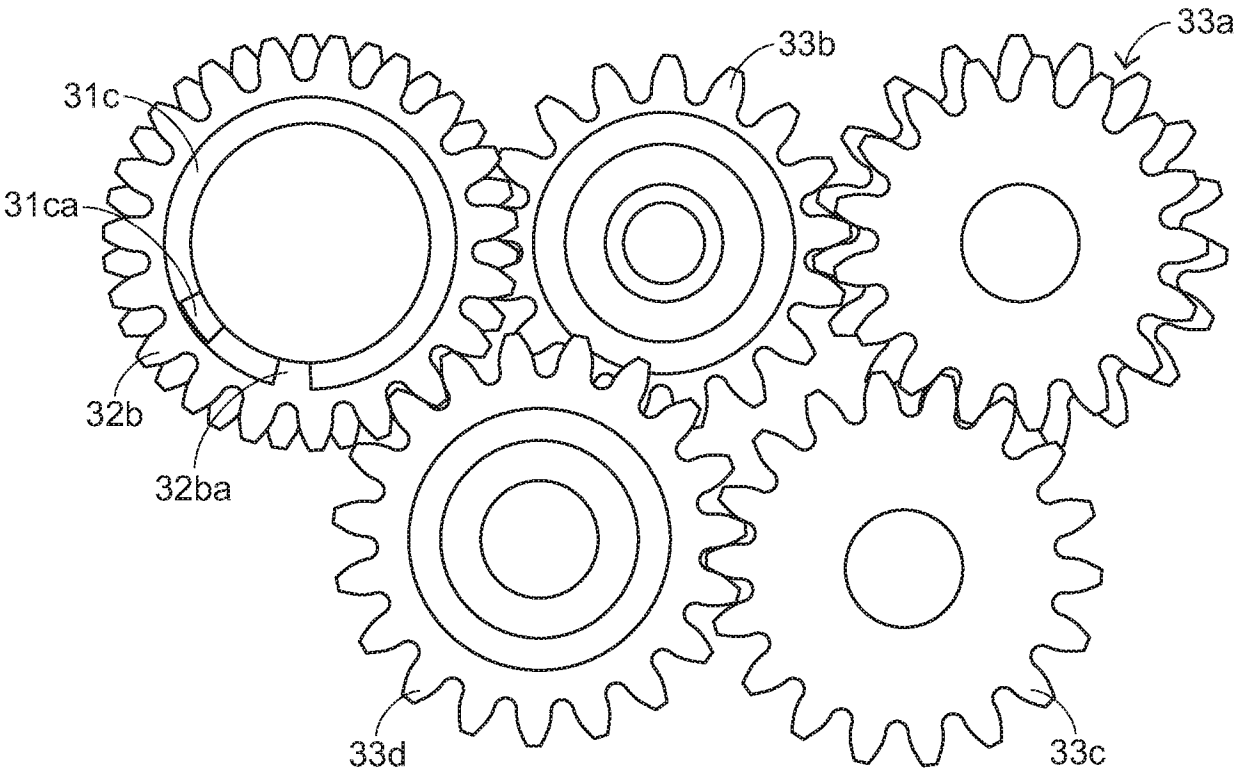
FIG. 12 is a schematic side view illustrating the first gear, the second gear and the power transmission mechanism of the paper deskew device according to the embodiment of the present invention, in which the movement of the paper is driven by the transport roller assembly.

Hereinafter, the operations of the paper deskew device of the present invention will be illustrated with reference to FIGS. 7~12. For illustrating the performance of the paper deskew device of the present invention, the following drawings will be described by referring a skewed paper, in which the skew phenomenon is generated during the paper-feeding process. FIG. 7 is a schematic perspective view illustrating the paper deskew device according to the embodiment of the present invention, in which the front edge of the paper is not contacted with the deskew roller assembly. FIG. 8 is a schematic side view illustrating the first gear, the second gear and the power transmission mechanism of the paper deskew device according to the embodiment of the present invention, in which the front edge of the paper is not contacted with the deskew roller assembly. FIG. 9 is a schematic perspective view illustrating the paper deskew device according to the embodiment of the present invention, in which the front edge of the paper is completely contacted with the deskew roller assembly. FIG. 10 is a schematic side view illustrating the first gear, the second gear and the power transmission mechanism of the paper deskew device according to the embodiment of the present invention, in which the front edge of the paper is completely contacted with the deskew roller assembly. FIG. 11 is a schematic perspective view illustrating the paper deskew device according to the embodiment of the present invention, in which the movement of the paper is driven by the transport roller assembly. FIG. 12 is a schematic side view illustrating the first gear, the second gear and the power transmission mechanism of the paper deskew device according to the embodiment of the present invention, in which the movement of the paper is driven by the transport roller assembly.

For clearly describing the status of the paper during the process of transporting the paper, the first idler wheel 31*e*, the second idler wheel 31*f*, the third idler wheel 32*d* and the fourth idler wheel 32*e* are not shown in FIGS. 7, 9 and 11.

After the paper-feeding task starts, the papers are successively fed into the automatic document feeder by a paper pick-up arm (not shown). Before the paper is introduced to the working region (e.g. the scanning region or the printing region), the paper should be transported through the paper deskew device 3 in order to correct the skew phenomenon.

After the front edge of the paper 4 is departed from the paper pick-up arm and moved toward the paper deskew device 3 (see FIG. 7), the shaft 31*a* is driven by a motor (not shown) to be continuously rotated in a first direction "x". Consequently, the first transport roller 31*b*, the first gear 31*c* and the second transport roller 31*d* are also rotated in the first direction "x".

Meanwhile, since the first bulge 31*ca* of the first gear 31*c* is separated from the second bulge 32*ba* of the second gear 32*b* by a distance, the first bulge 31*ca* and the second gear 32*b* are not interfered with each other (see FIG. 8). Under this circumstance, the first damping gear 33*aa* is driven by the first gear 31 to be rotated in the first direction "x". Due to the friction between the first damping gear 33*aa* and the damping spring 33*ac*, the damping spring 33*ac* is synchronously rotated with the first damping gear 33*aa*. Moreover, due to the friction between the damping spring 33*ac* and the second damping gear 33*ab*, the second damping gear 33*ab* is synchronously rotated with the damping spring 33*ac*. That is, the second damping gear 33*ab* is also rotated in the first direction "x", thereby driving the second gear 32*b* to be rotated in a second direction "y".

From the above discussions, before the front edge of the paper 4 is moved to the paper deskew device 3, the first deskew roller 32*a* and the second deskew roller 32*c* are rotated in the second direction "y".

Once one side of the front edge of the paper 4 is contacted with the first deskew roller 32*a*, the first deskew roller 32*a* and the second deskew roller 32*c* are continuously rotated in the second direction "y" for a predetermined time period, so that the paper 4 is blocked from being continuously advanced.

Since the paper 4 is continuously transported by the paper pick-up arm (not shown) during the above predetermined time period, the paper is upturned. Until the other side of the front edge of the paper 4 is contacted with the second deskew roller 32*c*, the front edge of the paper 4 is completely parallel with the first deskew roller 32*a* and the second deskew roller 32*c* (see FIG. 9), so that the skew phenomenon of the paper 4 is corrected.

As previously described, the first gear 31*c* and the second gear 32*b* are continuously rotated in opposite directions. After the above predetermined time period, the first bulge 31*ca* of the first gear 31*c* and the second bulge 32*ba* of the second gear 32*b* are contacted with each other (see FIG. 10).

Then, the second bulge 32*ba* of the second gear 32*b* is pushed by the first bulge 31*ca* of the first gear 31*c* to be rotated in the first direction "x". Consequently, the first deskew roller 32*a* and the second deskew roller 32*c* start to be rotated in the first direction "x". At the same time, the paper 4 is clamped between the first deskew roller 32*a* and the third idler wheel 32*d* and between the second deskew roller 32*c* and the fourth idler wheel 32*e*, so that paper 4 is moved forwardly in the paper-feeding direction.

Moreover, after the second gear 32*b* is pushed by the first gear 31*c*, the friction between the damping spring 33*ac* and the second damping gear 33*ab* fails to drive the second damping gear 33*ab* to be synchronously rotated with the damping spring 33*ac*. Consequently, the first damping gear 33*aa* is continuously rotated in the first direction "x", and the second damping gear 33*ab* is driven by the fourth gear 33*c* to be rotated in the second direction "y".

Then, the paper 4 is transported to the first transport roller 31*b* and the second transport roller 31*d*. Then, the paper 4 is clamped between the first transport roller 31*b* and the first idler wheel 31*e* and between the second transport roller 31*d* and the second idler wheel 31*f*, so that the paper is continuously moved in the paper-feeding direction (see FIG. 11).

From the above discussions, the radius of each of the first deskew roller 32*a* and the second deskew roller 32*c* is smaller than the radius of each of the first transport roller 31*b* and the second transport roller 31*d*. Consequently, after the movement of the paper 4 starts to be driven by the first transport roller 31*b* and the second transport roller 31*d*, the first deskew roller 32*a* and the second deskew roller 32*c* are driven by the paper 4 to be rotated for more turns within the same time period. In other words, the distance between the second bulge 32*ba* of the second gear 32*b* and the first bulge 31*ca* of the first gear 31*c* is gradually increased (see FIG. 12).

From the above discussions, after the paper 4 is completely departed from the first deskew roller 32*a* and the second deskew roller 32*c*, the first bulge 31*ca* of the first gear 31*c* is separated from the second bulge 32*ba* of the second gear 32*b* by a distance, and thus the second bulge 32*ba* is no longer pushed by the first bulge 31*ca*. Then, the second gear 32*b*, the first deskew roller 32*a* and the second deskew roller 32*c* are driven by the power transmission mechanism 33 again to be rotated in the second direction "y". Then, the skew phenomenon of a next paper will be corrected in the above manner.

In the above embodiments, by means of the first gear, the second gear and the power transmission mechanism, the paper deskew device of the present invention is capable of correcting the skew phenomenon of the paper during the process of feeding the paper without the need of changing the operating status or the rotating direction of the transport roller assembly.

From the above description, the transport roller assembly of the paper deskew device of the present invention only needs to be continuously rotated in the same direction. In such way, the deskew roller assembly can be actively rotated in the first direction to feed the paper or rotated in the second direction to block the paper from being advanced and correct the skew phenomenon of the paper. By using the paper deskew device of the present invention, the time period from the positive rotation to the reverse rotation of the motor or the time period from suspension to start of the motor will be saved. Moreover, since it is not necessary to frequently change the operating status of the motor, the possibility of causing damage of the motor will be largely reduced. In other words, the use of the paper deskew device of the present invention can prolong the life of the automatic document feeder.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A paper deskew device for use in an automatic document feeder to correct a skew phenomenon of a paper fed into said automatic document feeder, said paper deskew device comprising:

a transport roller assembly comprising:

a shaft; and a first transport roller sheathed around a first end of said shaft, and driven by said shaft to be rotated in a first direction; and a deskew roller assembly disposed on said shaft, and comprising a first deskew roller, which is sheathed around said first end of said shaft, wherein a movement of said paper is firstly driven by said first deskew roller and then driven by said first transport roller, wherein before said movement of said paper is driven by said first deskew roller, said first deskew roller is rotated in a second direction, wherein once a front edge of said paper is contacted with said first deskew roller, said first deskew roller is continuously rotated in said second direction for a predetermined time period, and then said first deskew roller is rotated in said first direction, so that said paper is transported to said first transport roller, wherein after said paper is completely departed from said first deskew roller, said first deskew roller is rotated in said second direction again, wherein said first direction is opposed to said second direction.

2. The paper deskew device according to claim 1, wherein said transport roller assembly further comprises a first gear, said first gear is sheathed around said shaft and located beside said first transport roller and driven by said shaft to be rotated in said first direction, and said first gear has a first bulge, wherein said deskew roller assembly further comprises a second gear, said second gear is connected to a sidewall of said first deskew roller and rotated with said first deskew roller, and said second gear has a second bulge.

3. The paper deskew device according to claim 2, further comprising a power transmission mechanism, wherein said power transmission mechanism is connected with said first gear and said second gear for driving said first deskew roller to be rotated in said second direction.

4. The paper deskew device according to claim 3, wherein after said first deskew roller is rotated in said second direction for said predetermined time period, said first bulge of said first gear and said second bulge of said second gear are contacted with each other, so that said second gear is pushed by said first gear to be rotated in said first direction and said first deskew roller is rotated in said first direction.

5. The paper deskew device according to claim 4, wherein a radius of said first deskew roller is smaller than a radius of said first transport roller, wherein after said paper is driven by said first transport roller to be moved, said paper allows said second bulge of said second gear to be separate from said first bulge of said first gear.

6. The paper deskew device according to claim 3, wherein said power transmission mechanism comprises a damping gear set, which includes a first damping gear, a second damping gear and a damping spring, wherein said damping spring is disposed within said first damping gear and said second damping gear.

7. The paper deskew device according to claim 6, wherein before said first deskew roller is rotated for said predetermined time period, said first damping gear, said second damping gear and said damping spring are rotated in the same direction, wherein after said first deskew roller is rotated for said predetermined time period, said first damping gear and said second damping gear are rotated in opposite directions.

8. The paper deskew device according to claim 6, wherein said power transmission mechanism further comprises a third gear, a fourth gear and a fifth gear, wherein said third gear is engaged with said first gear and said first damping gear, said fourth gear is engaged with said second damping gear and said fifth gear, and said fifth gear is engaged with said fourth gear and said second gear.

9. The paper deskew device according to claim 1, wherein said transport roller assembly further comprises a second transport roller, a first idler wheel and a second idler wheel, wherein said second transport roller is sheathed around a second end of said shaft and synchronously rotated with said first transport roller, wherein a radius of said second transport roller is equal to a radius of said first transport roller, said first idler wheel is disposed over said first transport roller and driven by said first transport roller to be rotated, and said second idler wheel is disposed over said second transport roller and driven by said second transport roller to be rotated.

10. The paper deskew device according to claim 1, wherein said deskew roller assembly further comprises a second deskew roller, a third idler wheel and a fourth idler wheel, wherein said second deskew roller is sheathed around a second end of said shaft and synchronously rotated with said first deskew roller, wherein a radius of said second deskew roller is equal to a radius of said first deskew roller, said third idler wheel is disposed over said first deskew roller and driven by said first deskew roller to be rotated, and said second idler wheel is disposed over said second deskew roller and driven by said second deskew roller to be rotated.

* * * * *